US007908955B1

(12) United States Patent
Chou et al.

(10) Patent No.: US 7,908,955 B1
(45) Date of Patent: Mar. 22, 2011

(54) ROPE STRUCTURES AND ROPE DISPLACEMENT SYSTEMS AND METHODS FOR LIFTING, LOWERING, AND PULLING OBJECTS

(75) Inventors: Chia-Te Chou, Bellingham, WA (US); Howard P. Wright, Jr., Ferndale, WA (US)

(73) Assignee: Samson Rope Technologies, Ferndale, WA (US)

( * ) Notice: Subject to any disclaimer, the term of this patent is extended or adjusted under 35 U.S.C. 154(b) by 126 days.

(21) Appl. No.: 12/243,079

(22) Filed: Oct. 1, 2008

Related U.S. Application Data

(60) Provisional application No. 60/998,034, filed on Oct. 5, 2007.

(51) Int. Cl.
*D04C 1/00* (2006.01)

(52) U.S. Cl. ..... 87/8

(58) Field of Classification Search ..... 87/8, 9, 87/11

See application file for complete search history.

(56) References Cited

U.S. PATENT DOCUMENTS

| | | | | |
|---|---|---|---|---|
| 3,367,095 | A | 2/1968 | Field, Jr. | |
| 4,947,917 | A | 8/1990 | Noma et al. | |
| 5,240,769 | A | 8/1993 | Ueda et al. | |
| 5,802,839 | A | 9/1998 | Van Hook | |
| 5,822,791 | A | 10/1998 | Baris | |
| 6,341,550 | B1 * | 1/2002 | White | 87/5 |
| 6,876,798 | B2 | 4/2005 | Triplett et al. | |
| 6,945,153 | B2 * | 9/2005 | Knudsen et al. | 87/1 |
| 7,127,878 | B1 | 10/2006 | Wilke et al. | |
| 7,134,267 | B1 | 11/2006 | Gilmore et al. | |
| 7,165,485 | B2 | 1/2007 | Smeets et al. | |
| 7,168,231 | B1 | 1/2007 | Chou et al. | |
| 7,367,176 | B1 | 5/2008 | Gilmore et al. | |
| 7,389,973 | B1 | 6/2008 | Chou et al. | |
| 7,437,869 | B1 | 10/2008 | Chou et al. | |
| 7,735,308 | B1 | 6/2010 | Gilmore et al. | |
| 7,739,863 | B1 | 6/2010 | Chou et al. | |
| 7,743,596 | B1 | 6/2010 | Chou et al. | |
| 2003/0226347 | A1 | 12/2003 | Smith et al. | |
| 2007/0079695 | A1 | 4/2007 | Bucher et al. | |

FOREIGN PATENT DOCUMENTS

| | | | |
|---|---|---|---|
| WO | 03102295 | A1 | 12/2003 |

* cited by examiner

*Primary Examiner* — Shaun R Hurley
(74) *Attorney, Agent, or Firm* — Michael R. Schacht; Schacht Law Office, Inc.

(57) ABSTRACT

A rope structure comprising a plurality of fibers combined to form a plurality of yarns which are in turn combined to form a plurality of strands. The plurality of strands are combined using a single braid process to form the rope structure defining a void space. At least one of the fibers, the yarns, and the strands are configured substantially to reduce a volume of the void space and thereby maintain a shape of the rope structure when the rope structure is under load.

17 Claims, 2 Drawing Sheets

ROPE STRUCTURES AND ROPE DISPLACEMENT SYSTEMS AND METHODS FOR LIFTING, LOWERING, AND PULLING OBJECTS

RELATED APPLICATIONS

This application claims priority of U.S. Provisional Patent Application Ser. No. 60/998,034 filed Oct. 5, 2007, the contents of which are incorporated herein by reference.

TECHNICAL FIELD

The present invention relates to rope structures and, more particularly, to rope displacement systems and methods adapted to lift, lower, and pull objects using a rope structure and the assistance of mechanical device such as a winch.

BACKGROUND

Rope is often used to displace an object. The object is supported by a distal portion of the rope, and a proximal portion of the rope is displaced to place the rope under tension and thereby displace the load. To displace the proximal portion of the rope, a winch device is often used. Examples of winch devices include a drum or spool winch, a windlass, and a capstan. The winch device may be human powered or motorized. In either case, the winch provides a mechanical advantage. When human powered, although human effort is required, the winch eliminates the need to grip the rope. When motorized, the winch eliminates the need for human effort altogether.

A winch typically defines an engaging surface that can take many forms. For a winch employing a drum or spool, the engaging surface is essentially cylindrical, often having side walls. For a winch in the form of a capstan or windlass, the engaging surface can be cylindrical or can define an annular cavity the cross-sectional area of which decreases towards the axis of rotation.

With any form of winch, at least an active portion of the rope is wound around the drum such that, when the drum is rotated about a longitudinal drum axis, friction causes a working portion of the rope under tension to be displaced along a pulling axis. For many winch systems, a stored portion of the rope can be stored on the drum; for other winch systems, such as when the winch takes the form of a capstan or windlass, the stored portion of the rope is stored separate from the winch. The friction may be between the active portion of the rope and the engaging surface or between the active portion of the rope and a stored portion of the rope already wound around the drum.

Loads on the active portion of a rope that is being displaced using a winch thus include tension loads that extend between the winch and the load, bearing loads directed radially inwardly towards the axis of the winch, and compression loads directed inwardly towards the longitudinal axis of any portion of the rope.

In the case of a winch having a drum or spool, the active portion of the rope engages the stored portion of the rope wrapped around the drum or spool. The stored portion of the rope defines shallow grooves between adjacent stored portions. The bearing loads on the active portion of the rope tend to pull the active portion of the rope down into these grooves. Compression loads on the active portion of the rope tend to deform the active portion of the rope to fit into the grooves formed by the stored portion of the rope. As the spool turns, the active portion of the rope is wound onto the drum and becomes the stored portion. The stored portion is no longer under significant tension load, but still may lie within a groove.

In another case, the rope may be taken up by a capstan or windlass having a friction surface defined by an annular V-shaped groove. The active portion of the rope is fed into the V-shaped groove. The slanted sides defining the V-shaped groove increase friction between the capstan or windlass and the rope but apply compression loads on the active portion of the rope. These compression loads tend to deform the rope such that the rope is forced towards the bottom of the V-shaped groove.

Accordingly, one or both of the active portion and the stored portion of the rope may be forced into a groove and become bound within the winch. When a rope is bound within the winch, the displacement of rope by the winch or the removal of the stored portion of the rope from the winch may be disrupted.

The need thus exists for rope structures and rope displacement systems and methods for lifting, lowering, and/or pulling ropes that are less susceptible to binding when displacing rope using a winch or unwinding rope from a winch.

SUMMARY

The present invention may be embodied as a rope structure comprising a plurality of fibers combined to form a plurality of yarns which are in turn combined to form a plurality of strands. The plurality of strands are combined using a single braid process to form the rope structure defining a void space. At least one of the fibers, the yarns, and the strands are configured substantially to reduce a volume of the void space and thereby maintain a shape of the rope structure when the rope structure is under load.

The present invention may also be embodied as a method of forming a rope structure comprising the following steps. A plurality of fibers are combined to form a plurality of yarns. The plurality of yarns are combined to form a plurality of strands. The plurality of strands are combined using a single braid process to form the rope structure defining a void space. At least one of the fibers, the yarns, and the strands are configured substantially to reduce a volume of the void space such that a shape of the rope structure is maintained when the rope structure is under load.

The present invention may also be embodied as a rope displacement system for displacing a rope connected to a load. As a rope displacement system, the present invention comprises a rope structure and a winch assembly. The rope structure comprises a plurality of fibers combined to form a plurality of yarns, where the plurality of yarns are combined to form a plurality of strands. The plurality of strands are combined using a single braid process to form the rope structure such that the rope structure defines a void space. at least one of the fibers, the yarns, and the strands are configured substantially to reduce a volume of the void space and thereby maintain a shape of the rope structure when the rope structure is under load. The winch assembly engages at least a portion of the rope structure such that operation of the winch assembly displaces the rope structure.

DETAILED DESCRIPTION

Figure 1:
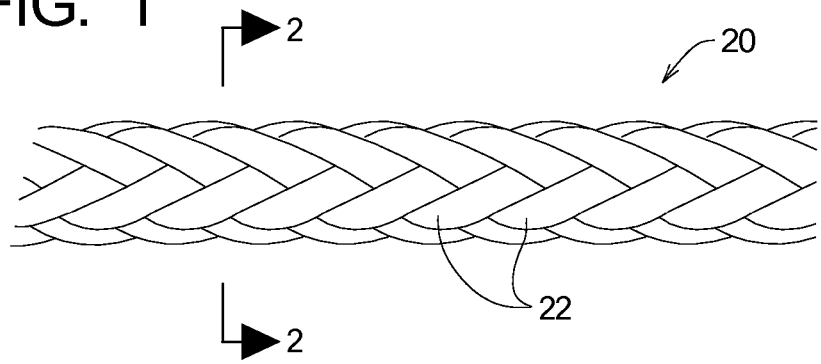
FIG. 1 is a front elevation view of a first example rope system that may form at least part of the present invention.
Figure 2:
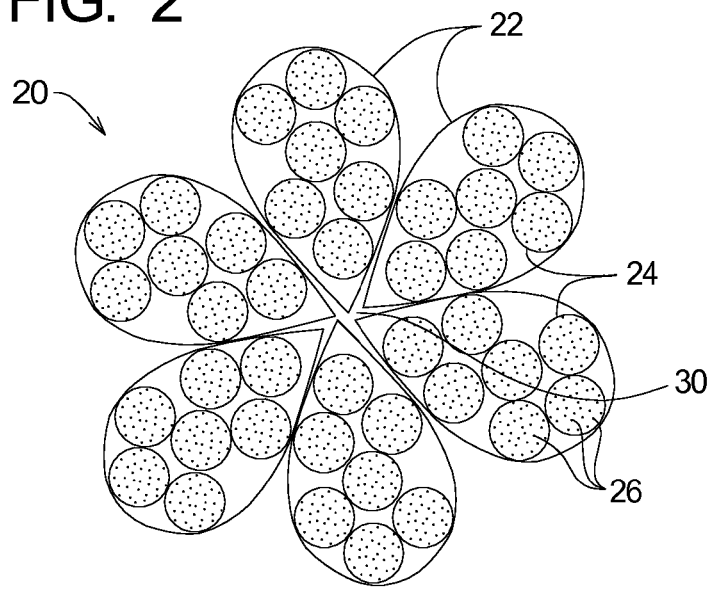
FIG. 2 is a section view taken along lines 2-2 in FIG. 1.

Depicted in FIG. 1 is a first example rope structure 20 constructed in accordance with, and embodying, the principles of the present invention. As shown in FIGS. 1 and 2, the example rope structure comprises a plurality of strands 22. FIG. 2 further shows that each strand 22 comprises a plurality of yarns 24, and each yarn 24 comprises a plurality of fibers 26.

FIG. 2 illustrates that the first example rope structure 20 comprises six of the strands 22. The strands 22 of the example rope structure 20 are combined to form the rope structure 20 using a single braid process; a single braided rope structure defines a void space 30.

In the example rope structure 20, the yarns and strands are substantially the same in construction, composition, and nominal diameter. Although the strands forming the example rope structures 20 are all substantially the same in construction, composition, and nominal diameter, strands of differing composition and nominal diameter may be used to form a rope structure of the present invention.

The example rope structure 20 is formed of strands 22 comprising seven yarns 24. The number of yarns 24 is not important to the invention. The number of fibers 26 is also not important. As will be described in further detail below, the fibers 26 are combined into yarns 24 that are in turn combined into strands 22 that, when combined to form the rope structure 20, substantially eliminate or reduce the volume of the void space 30 within the rope structure 20 during normal use and/or substantially evenly distribute loads on the fibers 26 when the rope structure is under load.

The example rope structure 20 has a strand/rope ratio of the nominal diameters of the strands forming the example rope structure 20 to the nominal overall diameter of the rope structure 20 may be within a first range of approximately between 0.35 and 0.38 and in any event within a second range of approximately 0.33 and 0.40.

The fibers used to form the example rope structure 20 may be one or more fibers selected from the group consisting of polyamide (PA), polyethylene terephthalate/polyethersulfone (PET/PES), polypropylene (PP), polyethylene (PE), high modulus polyethylene (HMPE), liquid crystal polymer (LCP), Para-Aramid, poly p-phenylene-2,6-benzobisoxazole (PBO) fibers, and high modulus polypropylene (HMPP).

The construction and nominal diameters of the yarns and strands, the strand/rope ratio, and the materials used to form the fibers 26 are selected such that each of the strands 22 deforms somewhat substantially to fill the void space 30 within the rope structure 20 under normal use. The strands in FIG. 2 are thus depicted in a tear drop shape that is narrower towards the center of the rope structure 20 and wider towards the outer surface of the rope structure 20. The rope structure 20 thus resists compression and deformation under tension and compression loads and thus maintains a substantially circular overall shape in cross-section under normal use as will be described in further detail below.

Another object of the design of the example rope structure 20 is that the loads on the individual fibers 26 forming the rope structure 20 should be distributed as evenly as possible. Because the effective diameter of the strands 22 of the example rope structure 20 is larger than normal, simply forming the yarns 24 in a single step as conventional bundles of the fibers 26 will result in the length of the outermost of the fibers 26 being longer than that of the length of innermost of the fibers 26. Such differences in length may result in an uneven distribution of loads across the individual fibers 26 when the rope structure 20 is under load.

The example strands 22 are thus formed according to one of the following processes. In a first example, the yarns 24 may be formed using a conventional single twist process.

Second, the yarns 24 may be formed using a two-step twist process in which a first set of the fibers 26 is first twisted together and a second set of the fibers 26 is then twisted around the first set of fibers. When combined using this two-stage process, the twists applied to the first and second sets of fibers 26 are different and are determined such that the length of the fibers 26 in each of the first and second sets is approximately the same; loads on the rope structure 20 will thus be somewhat evenly distributed across the fibers 26.

Alternatively, instead of simply bundling the fibers 26 to form the yarns 24 and bundling the yarns 24 to form the strands, the yarns 24 forming the strands 22 may be combined using a rope-making process such as twisting or braiding. For example, the yarns 24 may be combined in the same manner as a 3-strand rope. In this case, the rope structure 20 is formed of a plurality of small 3-strand ropes. Using a twisting or braiding rope-making process to form the strands 22 allows the rope structure 20 to is be fabricated such that loads on the rope structure 20 are substantially evenly distributed across the fibers 26.

Yet another method of forming the example strands 22 of the rope structure 20 is to use a first set of fibers 26 of a first material and a second set of fibers 26 of a second material, where the elongation of the first and second materials is different. When fibers of two different materials are used, the first and second sets of fibers 26 are bundled such that the uneven elongation of the fibers in the first and second sets results in substantially even distribution of loads across the fibers 26 when the rope structure 20 is under load.

The example rope structure 20 is of particular importance when used as part of a rope displacement system comprising a winch assembly. Several example rope displacement systems of the present invention will now be described with reference to FIGS. 3A, 3B, 4A, and 4B.

Figure 3A:
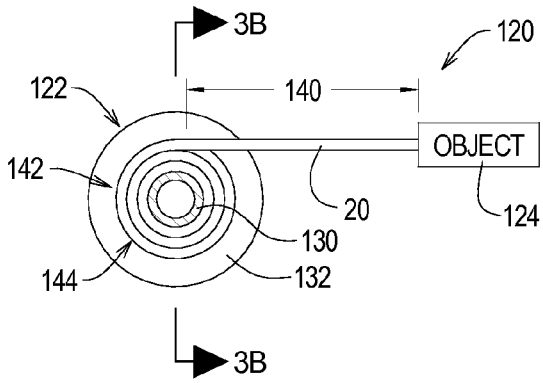
FIG. 3A is a section view of a first example rope displacement system and method for lifting, lowering, and/or pulling an object.
Figure 3B:
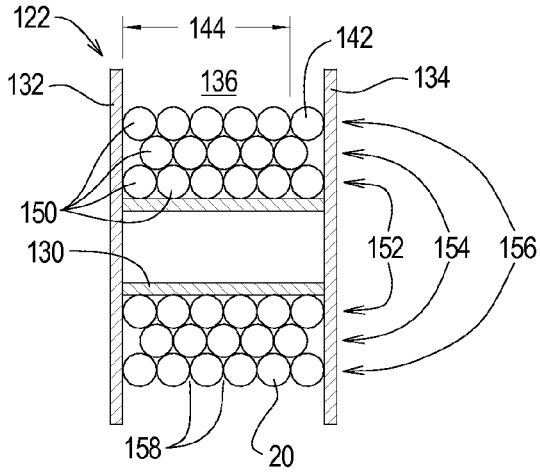
FIG. 3B is a section view taken view taken along lines 3B-3B in FIG. 3A.

Referring initially to FIGS. 3A and 3B of the drawing, depicted therein is a first example rope displacement system 120 constructed in accordance with, and embodying, the principles of the present invention. The first example rope displacement system 120 comprises a winch assembly 122 and the example rope structure 20. The rope structure 20 extends between the winch assembly 122 and an object 124 to be displaced using the rope displacement system 120.

The example winch assembly 122 is drum or spool type winch having a substantially cylindrical portion 130 and first and second side walls 132 and 134. The side walls 132 and 134 are affixed to ends of the cylindrical portion 130 to define an annular winch chamber 136.

As is conventional, the cylindrical portion 130 is adapted to be rotated about its longitudinal axis. The cylindrical portion 130 can be rotated by hand using a crank or the like or by a motor assembly. The side walls 132 and 134 help prevent the rope structure 20 from leaving the winch chamber 136 as the rope structure 20 is wound onto the cylindrical portion 130.

As schematically depicted in FIGS. 3A and 3B, when in use the rope structure 20 defines a working portion 140 extending between the winch assembly 122 and the object 124, an active portion 142 that extends at least partly around the cylindrical portion 130, and a stored portion 144 that is wound around the cylindrical portion 130. The working portion 140 and the active portion 142 are under tension when the object 124 is applying load forces on the rope displacement system 120, while the stored portion 144 of the rope structure 20 is not under significant tension.

FIGS. 3A and 3B illustrate that the rope structure 20 is arranged in a plurality of windings 150 that form first, second, and third layers 152, 154, and 156 on the cylindrical portion 130 of the winch assembly 122. The first two layers 152 and 154 and part of the third layer 156 are formed by the stored portion 144, and part of the third layer 156 is formed by the active portion 142. Between each of the windings 150 is a narrow groove 158.

FIG. 3B illustrates that the windings 150 forming each of the layers 152, 154, and 156 are uniformly spaced and are circular in cross-section. Further, while the narrow grooves 158 are formed between each of the windings 150, the windings 150 are not deformed such that they pull into these grooves 158. While somewhat idealized, FIG. 3B illustrates that the example rope structure 20 described herein allows the windings 150 to be arranged in an orderly matrix that reduces the likelihood of binding within the winch assembly 122.

Figure 4A:
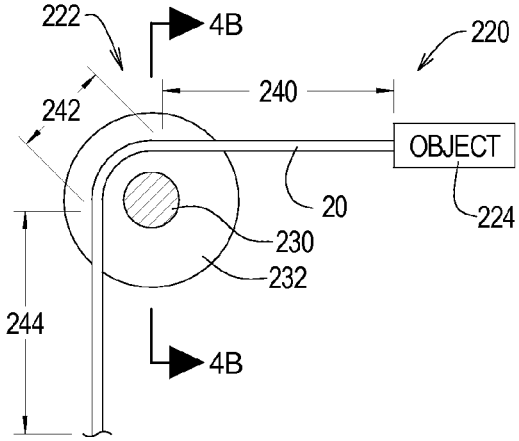
FIG. 4A is a section view of a second example rope displacement system and method for lifting, lowering, and/or pulling an object.
Figure 4B:
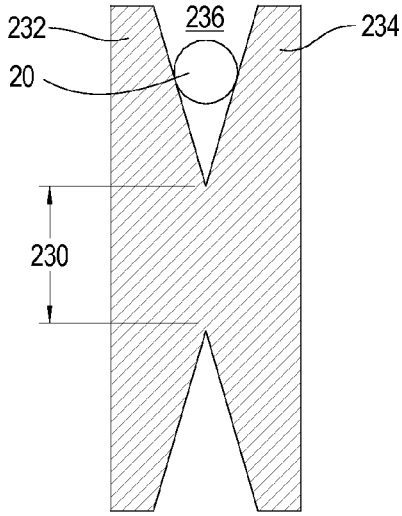
FIG. 4B is a section view taken view taken along lines 4B-4B in FIG. 4A.

Referring now to FIGS. 4A and 4B of the drawing, depicted therein is a second example rope displacement system 220 constructed in accordance with, and embodying, the principles of the present invention. The first example rope displacement system 220 comprises a winch assembly 222 and the example rope structure 20. The rope structure 20 extends between the winch assembly 222 and an object 224 to be displaced using the rope displacement system 220.

The example winch assembly 222 is windlass-type winch having a hub portion 230 and first and second side walls 232 and 234. The side walls 232 and 234 extend from the hub portion 230 to define an annular, V-shaped winch chamber 236 that narrows towards the hub portion 230. As is conventional, the hub portion 230 is adapted to be rotated about its longitudinal axis. The hub portion 230 can be rotated by hand using a crank or the like or a motor assembly. As shown in FIG. 4B, the side walls 232 and 234 are inwardly slanted.

As schematically depicted in FIGS. 4A and 4B, when in use the rope structure 20 defines a working portion 240 extending between the winch assembly 222 and the object 224 and an active portion 242 that extends at least partly around the hub portion 230, and a collected portion 244 that has exited the winch chamber 236. The working portion 240 and the active portion 242 are under tension when the object 224 is applying load forces on the rope displacement system 220; the collected portion 244 of the rope structure 20 is not under significant tension and may be stored by any suitable means.

FIGS. 4A and 4B illustrate that the rope structure 20 is firmly held between the slanted side walls 232 and 234 within the winch chamber 236 but does not substantially deform. Significant friction is thus established between these side walls 232 and 234 and the rope structure 20. Because the rope structure 20 maintains its substantially circular cross-section, the rope structure 20 is less likely to be forced into the narrowest part of the winch chamber 236 under heavy loads and thus bind within the winch assembly 222.

From the foregoing, it should be apparent that the present invention may be embodied in forms other than the example rope structures and systems and methods for displacing rope structures described herein.

What is claimed is:

1. A rope structure comprising:

first and second sets of fibers, where the first set of fibers is twisted together, the second set of fibers is twisted around the first set of fibers to form a plurality of yarns, and twists applied to the first and second fibers are determined such that lengths of fibers in the first and second sets are approximately the same;

the plurality of yarns are combined to form a plurality of strands; wherein the rope structure has a strand/rope ratio of the nominal diameters of the strands to the nominal overall diameter of the rope structure of approximately between 0.33 and 0.40;

the plurality of strands are combined using a single braid process to form the rope structure, where the rope structure defines a void space; and at least one of the fibers, the yarns, and the strands are configured substantially to reduce a volume of the void space and thereby maintain a shape of the rope structure when the rope structure is under load.

2. A rope structure as recited in claim 1, in which the rope structure has a strand/rope ratio of approximately between 0.34 and 0.38.

3. A rope structure as recited in claim 1, in which the fibers are formed from at least one material selected from the group consisting of polyamide (PA), polyethylene terephthalate/polyethersulfone (PET/PES), polypropylene (PP), polyethylene (PE), high modulus polyethylene (HMPE), liquid crystal polymer (LCP), Para-Aramid, and poly p-phenylene-2,6-benzobisoxazole (PBO) fibers.

4. A rope structure as recited in claim 1, in which the fibers are formed from high modulus polypropylene (HMPP).

5. A rope structure as recited in claim 1, in which the rope structure is formed such that loads on the rope structure are substantially evenly distributed across individual fibers forming the rope structure.

6. A rope structure as recited in claim 5, in which the yarns forming the strands are combined using one of a twisting process and a braiding process.

7. A rope structure as recited in claim 5, in which the yarns are combined to form strands in the form of a 3-strand rope.

8. A rope structure as recited in claim 5, in which:

a first set of fibers is formed of a first material; and a second set of fibers is formed of a second material; wherein elongation of the first set of fibers is different from elongation of a second set of fibers.

9. A method of forming a rope structure comprising the steps of:

providing first and second sets of fibers;

twisting together the fibers of the first set;

twisting the fibers of second set around the fibers of the first set to form a plurality of yarns, where the twists applied to the first and second fibers are determined such that lengths of the fibers in the first and second sets are approximately the same;

combining the plurality of yarns to form a plurality of strands;

combining the plurality of strands using a single braid process to form the rope structure, where the rope structure defines a void space; and configuring at least one of the fibers, the yarns, and the strands such that the rope structure has a strand/rope ratio of the nominal diameters of the strands to the nominal overall diameter of the rope structure of approximately between 0.33 and 0.40 such that volume of the void space is substantially reduced and a shape of the rope structure is maintained when the rope structure is under load.

10. A method as recited in claim 9, in which the steps of combining the yarns to form the strands and combining the strands to form the rope structure comprises the step of configuring a strand effective diameter and a rope effective diameter such that the rope structure has a strand/rope ratio of approximately between 0.35 and 0.38.

11. A method as recited in claim 9, in which the step of providing the fibers comprises the step of forming the fibers from at least one material selected from the group consisting of polyamide (PA), polyethylene terephthalate/polyethersulfone (PET/PES), polypropylene (PP), polyethylene (PE), high modulus polyethylene (HMPE), liquid crystal polymer (LCP), Para-Aramid, and poly p-phenylene-2,6-benzobisoxazole (PBO) fibers.

12. A method as recited in claim 9, in which the step of providing the fibers comprises the step of forming the fibers from high modulus polypropylene (HMPP).

13. A method as recited in claim 9, in which the step of combining the yarns to form the strands comprises the step of combining the yarns using one of a twisting process and a braiding process.

14. A method as recited in claim 9, in which the step of combining the yarns to form the strands comprises the step of combining the yarns to form strands in the form of a 3-strand rope.

15. A method as recited in claim 9, in which the step of providing the fibers comprises the steps of:

selecting first and second materials such that elongation of the first material is different from elongation of the second material;

providing a first set of fibers formed of the first material; and providing a second set of fibers formed of the second material.

16. A rope displacement system for displacing a rope connected to a load, comprising:

a rope structure comprising a plurality of fibers, where first and second sets of fibers are combined by twisting together the fibers of the first set and twisting the fibers of the second set around the first set of fibers to form a plurality of yarns, where twists applied to the first and second fibers are determined such that lengths of fibers in the first and second sets are approximately the same, the plurality of yarns are combined to form a plurality of strands, the plurality of strands are combined using a single braid process to form the rope structure, where the rope structure defines a void space, and at least one of the fibers, the yarns, and the strands are configured substantially to reduce a volume of the void space and thereby maintain a shape of the rope structure when the rope structure is under load; and a winch assembly; wherein the rope structure has a strand/rope ratio of the nominal diameters of the strands to the nominal overall diameter of the rope structure of approximately between 0.33 and 0.40;

the winch assembly engages at least a portion of the rope structure such that operation of the winch assembly displaces the rope structure.

17. A rope displacement system as recited in claim 16, in which the winch assembly is one of a drum-type winch and a windlass-type winch.

* * * * *